US005317592A

United States Patent [19]

Van Staden

[11] Patent Number: 5,317,592

[45] Date of Patent: May 31, 1994

[54] DIRECT RESISTANCE HEATING ELECTRICAL FURNACE ASSEMBLY AND METHOD OF OPERATING SAME

[75] Inventor: Petrus J. Van Staden, Edenvale, South Africa

[73] Assignee: Mintek, South Africa

[21] Appl. No.: 865,253

[22] Filed: Apr. 9, 1992

[30] Foreign Application Priority Data

Apr. 10, 1991 [ZA] South Africa ..... 91/2647

[51] Int. Cl.[5] ..... H05B 3/00

[52] U.S. Cl. ..... 373/109; 373/62; 373/108; 373/115; 373/120; 373/122; 373/135; 422/143; 422/145; 75/10.43

[58] Field of Search ..... 373/60, 62, 63, 66, 373/68, 111, 115, 118, 102, 70, 79, 2, 6, 23, 18, 22, 109, 122, 117, 135; 422/143, 145; 423/448, 460, 461; 75/10.43, 10.44, 10.45

[56] References Cited

U.S. PATENT DOCUMENTS

| | | | |
|---|---|---|---|
| 932,835 | 8/1909 | Trillon | 373/108 |
| 1,338,881 | 5/1920 | Stock . | |
| 2,027,786 | 1/1936 | Ridgway et al. . | |
| 3,641,249 | 2/1972 | Higgins . | |
| 3,895,174 | 7/1975 | Jung . | |
| 4,312,658 | 1/1982 | Mayer | 65/29 |
| 4,445,851 | 5/1984 | Scrantom et al. | 432/239 |
| 4,760,585 | 7/1988 | Queiser et al. | 373/122 |
| 5,107,517 | 4/1992 | Lauren | 373/18 |

*Primary Examiner*—Bruce A. Reynolds
*Assistant Examiner*—Tu Hoang
*Attorney, Agent, or Firm*—Mason, Fenwick & Lawrence

[57] ABSTRACT

A direct resistance heating electrical furnace of the type in which a bed of electrically conductive elements are located between two spaced electrodes in the furnace, and a method of controlling the operation of same, are provided. The furnace is of the type having a generally tubular heating chamber with a pair of spaced electrodes associated therewith and conveniently located one at each end of the tubular heating chamber. The furnace has feed or discharge control means and the rate of feed or discharge is controlled according to the electrical resistance or current flow between the electrodes. No temperature measurement is required to control the furnace operation.

19 Claims, 2 Drawing Sheets

DIRECT RESISTANCE HEATING ELECTRICAL FURNACE ASSEMBLY AND METHOD OF OPERATING SAME

FIELD OF THE INVENTION

This invention relates to direct resistance heating electrical furnaces of the type in which an electrically conductive solid particulate material is heated by passing electrical current directly through a bed thereof. Such particulate material may be introduced either in batchwise, semi-continuous, or continuous manner to the furnace. The invention also relates to a method of operating such a furnace assembly.

BACKGROUND TO THE INVENTION

Direct resistance heating electrical furnaces of various types have been proposed in which electrical current is passed between two spaced electrodes having a bed of conductive particulate material therebetween. The resistance of the bed causes it to heat and thereby give rise to some form of chemical or physical change in the material or other sub-divided, solid or gaseous materials admixed therewith.

As far as applicant is aware, the control of such furnaces is generally achieved either empirically by an operator or by measuring the temperature of the bed of particulate material at one or more predetermined positions within the furnace. The residence time of the material in the furnace at a predetermined temperature determines the extent of the chemical or physical change and thus the quality of the product.

The disadvantage of utilising temperature measurements, for example by means of one or more thermocouples at one or more specific locations within the furnace, is that the measurement may be inaccurate by reason of prevailing hot or cold spots at such location or locations. Also, where thermocouples are employed, their life is generally limited and often the operation of a furnace is interrupted when a thermocouple ceases to function correctly. These factors, in turn, lead to supervision being required and also to repair and replacement of components, in particular thermocouples, being necessary from time to time.

Furthermore, such furnaces often have an outlet valve at the bottom of the furnace which can have a deleterious effect on certain particulate materials being treated therein, for example granular activated carbon which is being reactivated.

It is the object of this invention to provide a direct resistance heating electrical furnace assembly and method of operating same in which the aforementioned disadvantages may, at least to some extent, be alleviated.

SUMMARY OF THE INVENTION

In accordance with one aspect of this invention there is provided a direct resistance heating electrical furnace comprising a heating chamber having an inlet for the introduction of material thereto and an outlet for the removal of heated material therefrom; a pair of spaced electrodes associated with the chamber which is adapted to receive an electrically conductive bed of solid particulate material, means for determining either the current flow or electrical resistance between the spaced electrodes, and control means coupled to the determining means for controlling the operation of the furnace.

Further features of the invention provide for the heating chamber to be a substantially vertically orientated tubular heating chamber; for the heating chamber to have an inlet at its operatively upper end and an outlet at its operatively lower end; for the electrodes to be axially spaced apart and, preferably, to be annular in shape conforming to the shape of a tubular heating chamber, and optionally forming a continuation thereof; for a heat exchanger to be associated with the outlet from the heating chamber for the recovery of heat from processed particulate material; and for the control means to be adapted to control the feed and/or discharge of material to or from the heating chamber according to signals received from the detector means.

Still further features of the invention provide for a discharge mechanism to be provided at the outlet to the heating chamber; for said discharge means to be activated and deactivated by the control means; and for the discharge means to be a transverse vibrating type of conveyor (feeder).

In accordance with a second aspect of this invention there is provided a method of controlling the operation of a direct resistance heating electrical furnace comprising determining the resistance and/or current flowing between the electrodes of a direct resistance heating furnace and controlling the feed and/or discharge, to or from the furnace, according to the detected current or resistance.

Further features of this aspect of the invention provide for discharged heated material to be passed through a heat exchanger for the recovery of heat therefrom and for the recovered heat to be employed for pre-heating and/or drying feed material to the furnace.

It is a particular feature of this invention that the particulate material being treated in the furnace be recycled granular activated carbon which is being subjected to reactivation. In such a case the furnace is provided with an inlet for steam or carbon dioxide and in this instance recovered heat from the outlet materials can be employed for the generation of the steam.

It will be understood that the basis of this invention relies on the fact that the resistance of a furnace charge, in this case the particulate material, decreases with increasing temperature and, accordingly, the resistance or current at a predetermined voltage, is employed as an indirect indication of the temperature profile in the furnace for any particular material. Consequently, the determination of resistance or current can be employed to control feed and/or discharge mechanisms to remove processed material and introduce further feed material.

In order that the invention may be more fully understood one embodiment thereof will now be described with reference to the accompanying drawing.

DETAILED DESCRIPTION WITH REFERENCE TO THE DRAWINGS

Figure 2A:
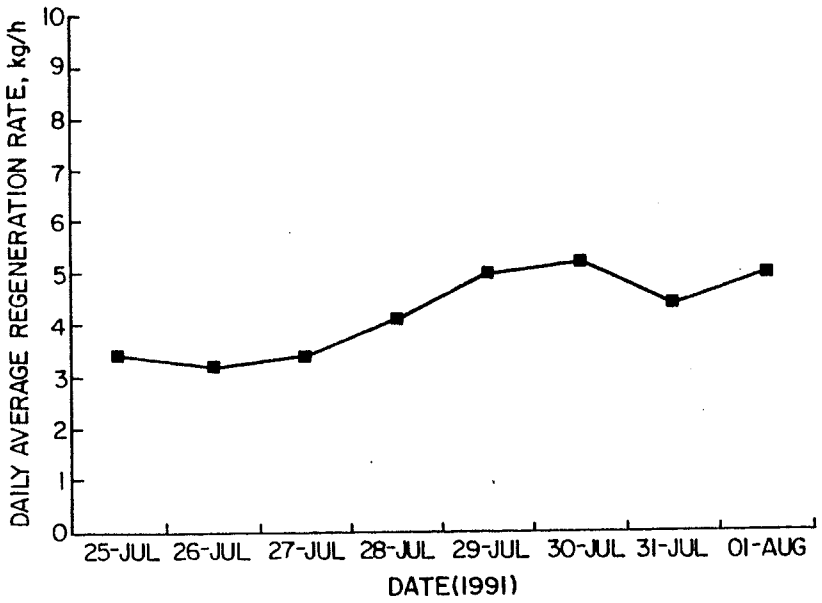
Figure 1:
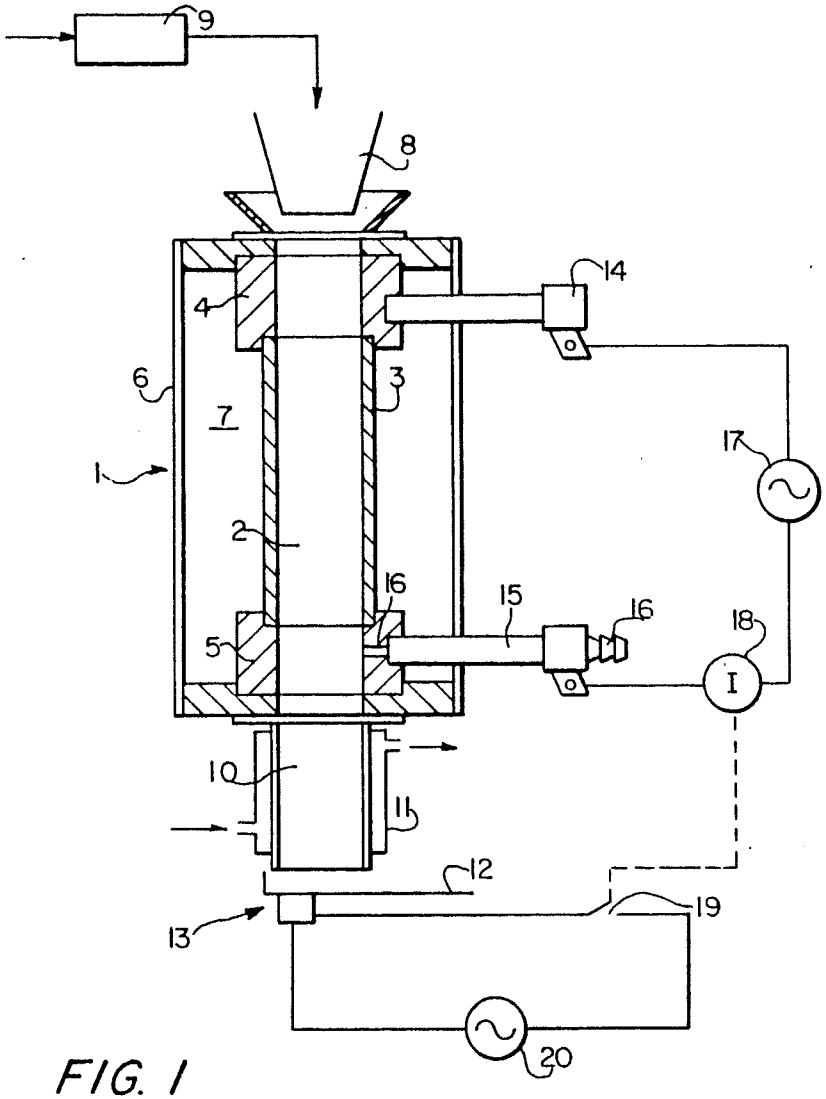
FIG. 1 is a schematic sectional illustration of a direct resistance heating electrical furnace adapted for operation according to the invention; and, FIGS. 2A, 2B and 2C (collectively referred to herein as FIG. 2) illustrate the controlled operation of the furnace in use.

In this embodiment of the invention a direct resistance heating electrical furnace, generally indicated by numeral 1, has a vertically extending tubular heating chamber 2 of circular cross-section, and the major portion of the length of which is defined by a refractory sleeve 3 for example of silicon carbide. At each end of the sleeve is an annular graphite electrode 4 and 5, the inner surfaces of which are aligned with the bore through the refractory sleeve 3 to form a continuous tubular heating chamber.

The electrodes and refractory sleeve are encased within a thermal insulation jacket 6 with suitable insulation material 7 therein.

The upper end of the furnace chamber has a hopper 8 for feeding materials thereto and the hopper, in turn, is fed from a dryer 9 for drying material to be fed to the furnace.

The lower outlet end of the furnace chamber communicates with a collinear heat exchanger 10 fitted with a heat exchange jacket 11.

The lowermost end of the heat exchanger is directed downwardly onto the tray 12 of a vibrating conveyor assembly, generally indicated by numeral 13, which is adapted to convey particulate material transversely away from the lower end of the heat exchanger.

It will be understood that material is retained in the furnace chamber and heat exchanger by the natural angle of repose of the particulate material resting on the tray of the vibrating conveyor and that material is only conveyed transversely away, to allow fresh feed material to enter at the top of the furnace chamber, when the vibrating conveyor is in fact in operation.

The electrodes have an upper terminal 14 connected to the upper electrode and a lower terminal 15 connected to the lower electrode for supplying electrical current thereto. The lower electrode may be tubular and embody a gas inlet 16 for the introduction of any required gases for a reaction being carried out in the furnace.

The terminals are connected to a power supply 17 and a detector/controller arrangement 18 is connected into the circuit so that the detector portion thereof detects the current flowing between the electrodes.

The controller of the arrangement embodies a switch activator which operates a switch 19 in a power supply 20 to the vibrating conveyor.

The above arrangement is such that, in operation, the current flowing between the terminals is monitored by the detector and, when it reaches a certain high value, the controller operates to close the circuit to the vibrating conveyor. The latter then operates to move particulate material resting thereon transversely away and make room for fresh feed material to enter the top of the furnace chamber.

In one application in which applicant is particularly interested, the furnace is employed for the reactivation of granular activated carbon which therefore forms the conductive particulate material within the furnace. In such a case steam, or carbon dioxide, can be introduced through the gas inlet 16 associated with the lower terminal 15.

Also, in this application, the wet carbon can be introduced into the dryer and can be dried by means of heat recovered from the heat exchanger 10 which serves to extract heat from reactivated carbon therein. Alternatively, such heat could be employed for generating steam to be introduced through the inlet 16.

Once sufficient feed material has moved into the furnace chamber, and partly reactivated and heated carbon moved downwardly somewhat in the furnace chamber, the current flowing between the electrodes will decrease. When it decreases to a predetermined extent, the controller switches off the power supply to the vibrating conveyor and the material ceases to move downwardly in the furnace chamber until the electrical current is once more at a predetermined high value. At that stage further reactivated carbon is ready for discharge into the heat exchanger and thence out by way of the vibrating conveyor.

In use, one commercial furnace was monitored to assess the performance and control thereof. The furnace was designed to have a capacity of 3 Kg/hr of granulated activated carbon to be regenerated. Steam was used to effect the regeneration and the furnace was substantially as described above.

The potential across the electrodes was maintained at 160 volts and the current monitored by the detector and the measurement utilised, through the controller 18, to stop and start the vibrating feeder to promote through flow and feed of fresh activated carbon to the top of the furnace.

Figure 2B:
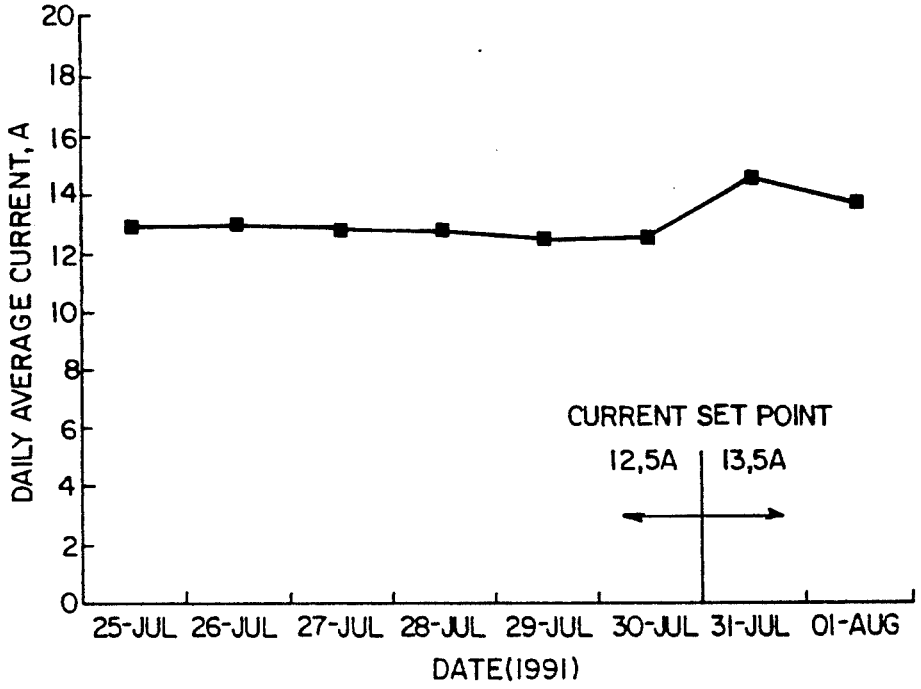
Figure 2C:
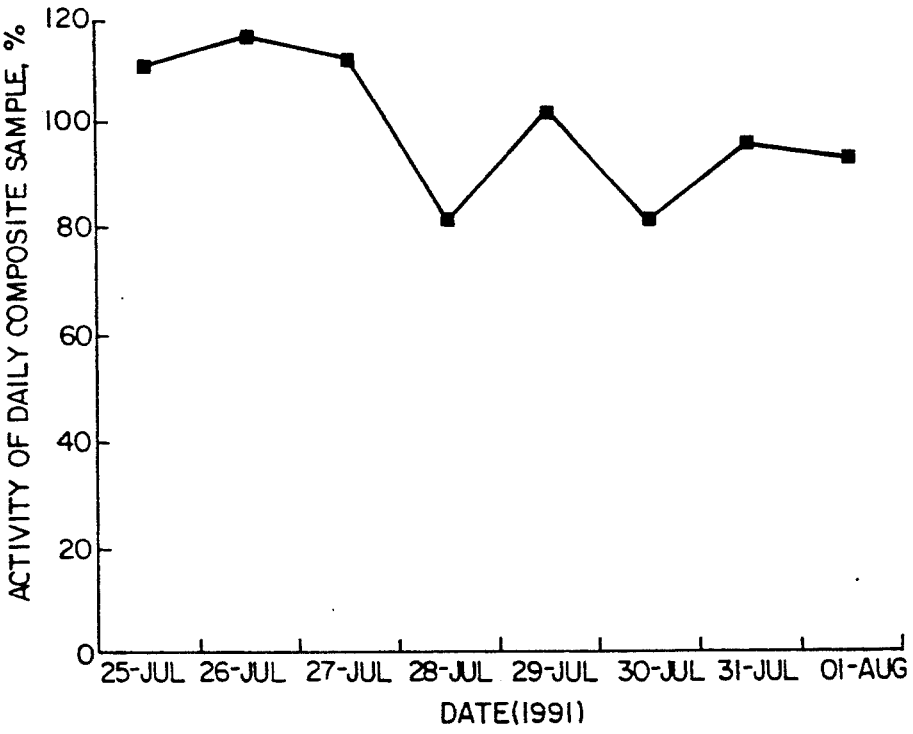

It was found that it was possible to control the discharge such that a required average production rate was achieved bearing in mind that discharge and consequent feed takes place in an intermittent fashion. The current required to achieve the necessary temperatures was about 13 Amps and the controller was adapted to switch the vibrating feeder on at a current of 15 Amps and off at a current of 12 Amps. Production rate varied apparently due to varying moisture contents of the feed. The results over an 8 day period are shown graphically in FIGS. 2A–C in which the feed (discharge) rate, current and activity of the regenerated granular activated carbon are shown as against time.

The furnace, and in particular the control thereof using the expedient of this invention therefore operated extremely well.

It will be understood that the furnace described above, and its method of operation, will provide for substantially less maintenance and supervision of a furnace of this nature as no thermocouples with their accompanying disadvantages need be present. On the other hand current measuring devices such as thyristors are highly reliable.

It will be understood that numerous variations may be made to the embodiment of the invention described above without departing from the scope hereof. In particular, the physical arrangement, shape and location of the electrodes can be varied widely as can the configuration of the furnace chamber. Also the means of controlling the flow of particulate material through the furnace chamber can be varied widely and, indeed, a conventional valve could be employed where it does not deleteriously affect the material being passed therethrough. It is to be mentioned that a vibrating conveyor is considered less deleterious than such valves, at least when applied to granular activated carbon. Also, the gas inlet 16 may be omitted entirely or may be relocated to any suitable position within the furnace as circumstances may dictate.

It is considered that a direct resistance heated furnace assembly operated in accordance with this invention will provide advantageous results and, also, will require less supervision and less maintenance than prior art similar assemblies.

What I claim as new and desire to secure by Letters Patent is:

1. A direct resistance heating electrical furnace, comprising:

a heating chamber having an inlet for feeding material thereto and an outlet for discharging heated material therefrom, the heating chamber constituting means for receiving an electrically conductive bed of solid particulate material;

a pair of spaced electrodes associated with the chamber;

means for determining a variable electrical quantity selected from a group consisting of current flow between the spaced electrodes, and (2) electrical resistance at a predetermined voltage across the spaced electrodes; and control means, coupled to the determining means, for controlling the feed and discharge of material to and from the heating chamber according to the variable electrical quantity;

wherein operation of the control means is carried out independently of direct temperature measurements of the electrically conductive bed of solid particulate material.

2. A furnace as claimed in claim 7 in which the heating chamber is a substantially vertically orientated tubular heating chamber.

3. A furnace as claimed in claim 1 in which the heating chamber has the inlet at an operatively upper end thereof and the outlet at an operatively lower end.

4. A furnace as claimed in claim 1 in which the heating chamber is tubular and the electrodes are spaced apart axially to define a heating zone therebetween.

5. The furnace of claim 4, wherein:

the electrodes are of annular shape and have inner surfaces forming a continuation of the tubular heating chamber.

6. The furnace of claim 1, wherein:

the outlet from the furnace has associated therewith a heat exchanger means for extracting heat from the product.

7. The furnace of claim 1, wherein the control means includes:

means for controlling the discharge of material from the heating chamber according to signals received from the determining means.

8. A furnace as claimed in claim 7 in which the outlet is provided with a discharge mechanism adapted to be activated and de-activated by the control means.

9. The furnace as claim 8, wherein:

the discharge mechanism is a transverse conveyor.

10. A furnace of claimed in claim 1 in which a gas inlet is provided for introducing active gas to the heating chamber.

11. The furnace of claim 10, wherein:

the gas inlet is located at a lower electrode.

12. A furnace as claimed in claim 11 in which the gas inlet is electrically conductive and forms the electrical terminal connection to the electrode.

13. A method of controlling operation of a direct resistance heating electrical furnace having a heating chamber with an inlet and an outlet, a pair of spaced electrodes associated with the chamber, means for determining a variable electrical quantity selected from a group consisting of current flow and electrical resistance between the spaced electrodes, and control means coupled to the determining means for controlling operation of the furnace, the method comprising the steps of:

feeding into the heating chamber electrically conductive solid particulate material;

discharging heated particulate material from the heating chamber;

heating the particulate material by passing an electrical current through the particulate material between the electrodes;

determining a variable electrical quantity which is one of the group consisting of (1) electrical resistance at a predetermined voltage across the electrodes, and (2) electrical current flowing between the electrodes; and controlling the feed and discharge of particulate material to and from the heating chamber according to the variable electrical quantity, independently of direct measurement of the temperature of the particulate material.

14. The method of claim 13, further comprising the step of:

extracting heat from the heated material which is discharged by passing it through a heat exchanger.

15. The method of claim 13, wherein:

the heating chamber has an outlet at the bottom thereof;

the material is held in the heating chamber by means of a transverse conveying means located beneath the outlet; and method further includes the step of activating and deactivating the conveying means to cause discharge of material from the heating chamber according to detected values of the variable electrical quantity.

16. The method of claim 9, further comprising:

applying a substantially constant voltage across the electrodes during operation.

17. The method of claim 9, further comprising:

feeding an active gas to the heating chamber during operation of the furnace.

18. The method of claim 17, wherein:

the material being heated is granulated carbon;

the active gas is steam or carbon dioxide; and the method is carried out so as to regenerate activated carbon.

19. The method of claim 15, wherein:

the conveying means is a vibrating feeder.

* * * * *